United States Patent [19]

Snedeker et al.

[11] Patent Number: 4,688,959

[45] Date of Patent: Aug. 25, 1987

[54] LIQUID APPLICATOR FOR CARPETS AND RUGS

[75] Inventors: Munson R. Snedeker, Bryan; Rodney J. O'Connor, College Station, both of Tex.

[73] Assignee: Texas Romec, Inc., College Station, Tex.

[21] Appl. No.: 783,461

[22] Filed: Oct. 2, 1985

[51] Int. Cl.[4] ..... A46B 11/04

[52] U.S. Cl. ..... 401/283; 401/24; 401/198; 401/208; 47/1.5; 15/24

[58] Field of Search ..... 401/21, 208, 197, 283, 401/22, 23, 24, 25, 198, 268; 15/25; 119/57, 59; 47/1.5, 1.7; 132/113, 120

[56] References Cited

U.S. PATENT DOCUMENTS

| | | | |
|---|---|---|---|
| D. 237,629 | 11/1975 | Keene . | |
| 596,090 | 12/1897 | Roux | 401/197 |
| 1,501,089 | 7/1924 | Andrews | 401/283 X |
| 1,829,589 | 10/1931 | Georgas | 15/24 |
| 1,921,901 | 8/1933 | Anderson . | |
| 2,194,484 | 3/1940 | Segal | 132/120 |
| 2,336,717 | 12/1943 | Crimmins | 401/22 |
| 2,604,102 | 7/1952 | Laing | 132/113 X |
| 2,719,994 | 10/1955 | Dorsey | 15/24 |
| 2,988,053 | 8/1958 | Minock . | |
| 3,103,916 | 9/1963 | Keene . | |
| 3,436,161 | 4/1969 | Charos | 401/197 |
| 3,651,600 | 3/1972 | Ewing | 47/1.5 |
| 3,877,823 | 4/1975 | Leland | 401/197 |
| 4,201,801 | 5/1980 | Hori | 401/197 X |
| 4,285,736 | 8/1981 | Arato | 401/197 X |
| 4,302,122 | 11/1981 | Moya | 401/283 |
| 4,389,812 | 6/1983 | Panttaja | 47/1.5 |
| 4,541,140 | 9/1985 | Allison | 401/197 |
| 4,585,018 | 4/1986 | O'Connor | 132/120 |

FOREIGN PATENT DOCUMENTS

| | | | |
|---|---|---|---|
| 0058612 | 7/1982 | European Pat. Off. | 47/1.5 |
| 197807 | 7/1978 | Japan | 401/208 |
| 147109 | 9/1949 | Sweden | 15/24 |
| 452811 | 5/1968 | Switzerland | 401/208 |

*Primary Examiner*—Richard J. Apley
*Assistant Examiner*—Robert W. Bahr
*Attorney, Agent, or Firm*—Baker & Kirk

[57] ABSTRACT

An apparatus is described for applying a liquid to treat the nap and backing of a rug or carpet. The applicator having a cylindrical body enclosing a hollow reservoir with teeth extending from inside the reservoir outwardly through the body such that the nap of the rug is penetrated to apply liquid to the backing of the rug. The teeth and, optionally, the cylindrical body are porous, allowing the treating liquid to migrate from the reservoir to the surface to be treated as the apparatus is moved across the surfaces.

8 Claims, 3 Drawing Figures

LIQUID APPLICATOR FOR CARPETS AND RUGS

FIELD OF THE INVENTION

This invention relates to an apparatus which is used for treating surfaces such as carpets or rugs with liquids. This treating is especially necessary when the carpets or rugs are in contact with household pets such as dogs, cats, mice, gerbels, etc.

While a household pet is an enjoyable experience there are problems which accompany pet ownership. Problems such as odor, skin diseases, pet hair, fleas, ticks and other parasites are common to household pets. These problems also tend to infiltrate the areas of the house frequented by the pet and particularly infests things touched by the pet. A common area that is touched by pets is the floor surface, particularly carpets and rugs. Surfaces such as tile and wood floors can be cleaned with a mop and cleaning agents. In contrast, surfaces such as rugs or carpets tend to become embedded with residue left by the pet. The odors, parasites or other problems will not only infiltrate the fibers comprising the nap of the carpet or the rug, but will also get into the backing which is below the surface of the fibers and then thrive between the fibers and the final floor surface.

Particularly troublesome are fleas which are brought into the house by the pet. The fleas may leave the dog to inhabit the rug or carpet. Worse yet, the fleas may lay eggs in the hair of the pet which fall off to hatch and begin a colony of fleas in the rug or carpet.

This invention relates to apparatus which transports a liquid, whether insecticide, fungicide, cleaning agent or deodorant, down into the fibers and further into the backing or mat of carpets or rugs. The various liquids are known to combat the parasites, odors, or other problems that are caused by household pets.

Accordingly, it is a primary object of this invention to provide apparatus for applying liquid insecticides, disinfectants, deodorizers, or other treating liquid to the nap and backing of carpets and rugs.

It is another object of this invention to also supply the liquid to the rug backing and carpeting in a uniform manner such that the carpet does not become soaked while yet receiving enough of the liquid to effectively treat undesirable characteristics of the carpet or rug.

PRIOR ART

The problem of ridding cloth, carpets, rugs or other fibrous material of pests and other problems caused by household pets has long plagued man. Over the years various devices have been described and tried in an effort to combat these problems.

U.S. Pat. No. 3,651,600 discloses a roller type herbicide applicator for lawns. The applicator is a perforated cylindrical roller surrounded by a permeable material to distribute a herbicide on a grassy surface. Rollers are present to lift and maintain the permeable material above the ground.

U.S. Pat. No. 2,988,053 discloses an insecticide applicator for livestock. The wheels of the device rotate, turning an interior blade to provide a means for even distribution of powdered insecticide through an opening in the cylindrical extension of the device.

U.S. Pat. No. 3,103,916 discloses a roller for applying a liquid to animals. This invention uses a rigidly constructed cylindrical tube which dispenses a liquid through small holes in the surface when an animal rubs against it. The animal comes to the device which is too big and bulky to take to the animal.

Even though cylindrical applicators are popular devices, nowhere in the prior art does an applicator exist which can effectively treat the fibers of the nap of the carpet and simultaneously penetrate deep into the mat or backing of the carpet or rug, to treat it as well as the sides of the fiber which makes up the nap. All devices thus far conceived have fallen far short in one way or another.

SUMMARY OF THE INVENTION

The present invention provides portable and easily maintained apparatus for effectively treating rugs or carpeting in order to kill pests such as fleas or to combat odors and the like in both the fibers or nap of the carpet and the backing simultaneously.

The apparatus used is comprised of a hollow cylinder rotatably mounted on an axle closed at the ends to form a reservoir with a filler means in at least one end. The liquid with which the reservoir is filled communicates with the outer surface to be treated through the optionally porous body of the cylinder and/or through porous liquid conducting teeth which extend from within the reservoir filled with liquid to outside the cylinder. The liquid is applied as the apparatus is moved across the rug or carpet being treated. During this motion the porous teeth penetrate through the nap to the base of the rug applying the liquid not only on the surface and base but through the entire depth of the nap.

DESCRIPTION OF THE PREFERRED EMBODIMENT

Figure 1:
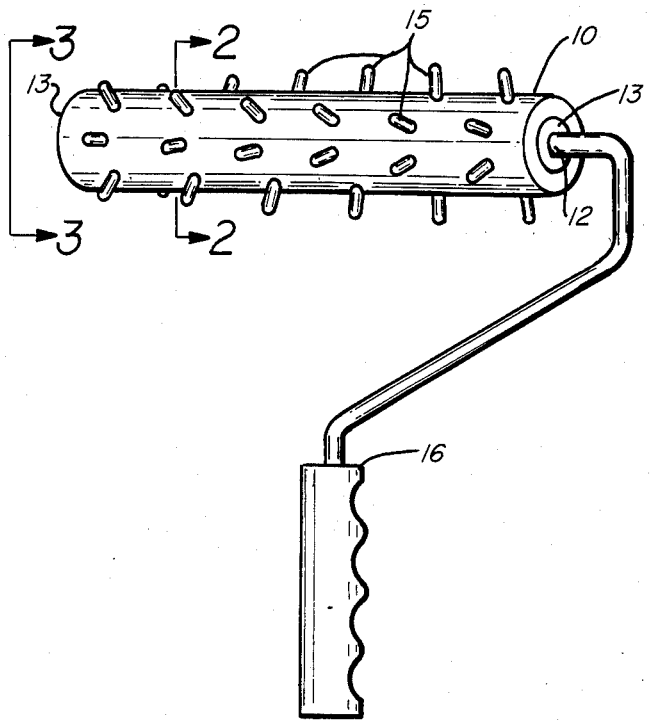
FIG. 1 is a perspective view of the applicator of the invention.

The applicator of this invention, as shown in FIG. 1, comprises, as major parts, a cylindrical body 10 which is preferably porous to allow liquid contained there to be dispensed. This body can be made of polyethylene, polyester, nylon, or any other type of rigid material which allows liquid to migrate through it for application to the surface being treated. Such materials are well known and the selection of a porous material of satisfactory strength is a matter of engineering design. The cylindrical body 10 surrounds a hollow reservoir 11 which is the holding area for the liquid. Preferably, the reservoir 11 will be filled with an absorbent packing 11a to hold the liquid evenly within the reservoir 11 and be sized to hold sufficient liquid to dispense over periods of time and cover sufficient areas to avoid frequent refilling. The body 10 and reservoir 11 concentrically surround the axle 12 upon which the cylindrical body 10 is rotatably mounted. The cylindrical body is closed at each end with circular non-porous caps 13 to create the reservoir 11. At least one of the caps 13 has a hole in the center in order to allow the concentric rotatable mounting or journaling, of the cylindrical body 10 on the axle 12 to be located at the center of the caps 13 along the center axis of the cylindrical body 10. Of course, those skilled in the art may provide other means for mounting the cylinder which will accomplish the purposes of this invention but the above described embodiment is preferred. The axle 12 is made of metal rod as tubing or some other well known structurally suitable material in order to absorb the strains exerted and avoid unacceptable deflection when the body 10 is rolled against the surface being treated.

The hollow reservoir 11 is filled with the liquid desired, whether insecticide or some other liquid, via filling means shown as removable plug 14 on the cap 13 of one end of the cylindrical body 10. A filling means could be located on both ends of the cylindrical body 10 but such is unnecessary. However, the presence of two filling means or a small vent through which air could escape during filling could expedite filling. During use, the liquid migrates from the hollow reservoir 11 via capillary action through the porous cylindrical body 10 and/or through porous teeth 15.

Figure 2:
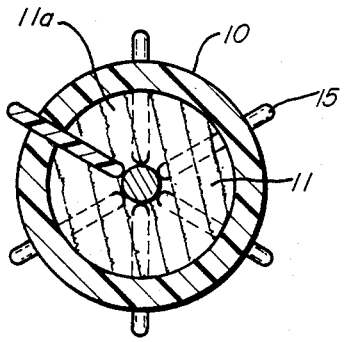
FIG. 2 is a cross section, through line 2—2, side elevation of the roller applicator.

These teeth 15 extend into the reservoir 11, as shown in FIG. 2, and communicate to outside the cylindrical body 10, generally having a sufficient length to penetrate through the nap of the carpet to the base such that the base and the fabric are contacted with the liquid. The reservoir 11 is preferably filled with a packing 11*a* to absorb the liquid and provide uniform and intimate contact with the part of the teeth 15 which penetrate the reservoir 11. The materials used for the filler may be any suitable material such as, for example, a natural fiber like cotton, or a synthetic material like rayon or nylon. A cellulosic fiber is preferred.

Figure 3:
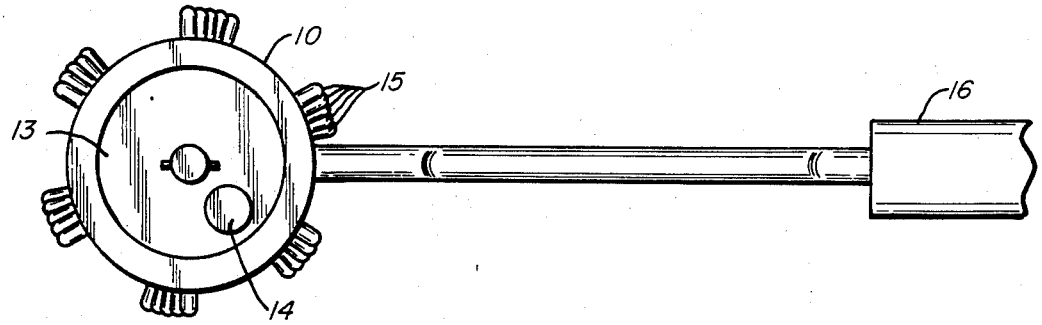
FIG. 3 is a side elevation view of the applicator.

The porous teeth 15 are arranged in rows running the length of the cylinder, as shown in FIG. 3 for example. The rows are equally spaced in order to achieve even distribution of the fluid and are arranged in a spiral orientation or similar line so as to not be parallel to the axis 12. The spiral line orientation is chosen to provide even distribution of liquid and smooth operation while moving the applicator along the carpet or rug. If rows were oriented parallel to the axle 12 of the apparatus uneven movement and bouncing would occur unless, of course, many rows, almost like a brush are used. Such arrangement is considered to be within the scope of the invention as long as a substantial number of the teeth 15 are porous, liquid-conducting teeth. In the practice of this invention a sufficient number of teeth 15 to properly treat a surface must be porous; the cylindrical body 10 may also be porous.

The orientation of the axle 12 is preferably such that the axle 12 extends out of an end cap 13 and turns at a 90° angle, for example, and is bent again as shown in FIG. 1 to form a means for moving the applicator across the carpet attached to a handle 16. This general arrangement is well known to those skilled in the art and similar to that employed in a home do-it yourself paint roller. When handle 16 is gripped and the surface of cylindrical body 10 is touched to the carpet or rug, the brush can be manually pushed and pulled in order to distribute the treating liquid into the carpet or rug. A long handle 16*a* would also be appropriate and is preferred to allow the user to stand upright and apply the liquid with much the same motion as if using a vacumn cleaner. Liquid dispensed through the surface of the body 10 contacts the upper portion of the nap of the carpet or rug and the teeth 15, in the preferred embodiment of the invention, excrete liquid through the sides throughout their length to coat the fibers of the carpet and through the ends, much like a felt tip pen, to treat the length of the fibers and backing of the carpet or rug.

In the preferred embodiment both the cylindrical body 10 and the teeth 15 are made of a porous material such as readily available porous nylon, polyethylene, or polyester synthetic polymers. At least the teeth 15 must be constructed of a porous material to accomplish objectives of the invention. The specific porous material is not critical but should have sufficient strength to sustain the pressures which will be exerted as the applicator of this invention is rolled and to allow treating liquid to migrate from the reservoir to the outside at a rate sufficient to coat both the surface and base of the rug or carpet as well as the sides of the fibers making up the nap of the rug. Nibs made of porous nylon or polyethylene such as those provided for use as "felt tip" pens are preferred. Their size and length may be varied as a matter of choice depending upon the anticipated use and carpet or rug to be treated.

The applicator of this invention can be of any suitable size depending upon the area to be treated. It is also highly portable and does not require much space for storage and can be hung on the wall much like a mop. Also, the materials of which the apparatus is constructed allows the applicator of this invention to be easily cleaned and rendered relatively safe for storage and transportation.

From the foregoing description and the attached drawings, those skilled in the art will be readily able to practice many variations and adaptations of this invention as set forth in the appended claims.

We claim:

1. An applicator adapted to apply liquids to rugs or carpets which comprises:

a cylindrical body closed at both ends and having a hollow center reservoir means for containing a liquid to be dispensed, said cylindrical body being constructed of porous material;

means for rotating said cylindrical body;

means for filling said hollow center reservoir means with liquid;

a plurality of radially distributed porous teeth extending from within said hollow center reservoir means, said porous teeth extending beyond the exterior surface of said cylindrical body to penetrate through the nap of said carpet to the base thereof, said teeth being constructed of porous material to allow liquid in said hollow center reservoir means to migrate outside said cylindrical body for application to said rug or carpet; and means for moving said applicator across said rug or carpet.

2. The applicator of claim 1 wherein said cylindrical body is constructed of porous polyethylene and said teeth are constructed of porous nylon.

3. The applicator of claim 1 wherein said cylindrical body is concentrically rotatably attached to an axle.

4. The applicator of claim 1 wherein said teeth are oriented on said cylindrical body in a spiral pattern to provide for even distribution, smooth operation and prevent bouncing.

5. The applicator of claim 4 wherein said teeth are oriented on said cylindrical body in a plurality of spirals.

6. The applicator of claim 1 wherein said reservoir means contains an absorbent material which becomes saturated by the liquid and maintains contact with said teeth.

7. The applicator of claim 6 wherein said teeth are porous nylon nibs.

8. An applicator for ridding rugs and carpets of fleas which comprises:

a cylindrical body made of liquid permeable porous polyethylene closed at both ends to form a hollow reservoir;

absorbent packing held within the reservoir;

a normally closed opening in at least one of the ends of the cylindrical body to provide a conduit through which liquid insecticide harmful to fleas may be introduced to fill the reservoir and wet the absorbent packing;

an axle, extending through the reservoir and journaled at the ends of the body along the axis of the body to allow for rotation of the body about the axle;

a handle connected to the axle to provide movement and rotation of the body about the axle across the carpet; and a plurality of liquid-conducting porous nylon teeth extending from adjacent the axle in contact with the packing, through the body to a distance outside the body whereby ends of the teeth penetrate through the depths of the carpet to apply flea-ridding insecticide to said carpet and backing.

* * * * *